US007578663B2

(12) United States Patent
Bratu

(10) Patent No.: US 7,578,663 B2
(45) Date of Patent: Aug. 25, 2009

(54) COMBINED PUMP WITH ROTODYNAMIC IMPELLER

(75) Inventor: Christian Bratu, 35, Les Vergers de la Ranchére, Saint Nom la Breteche (FR) 78860

(73) Assignee: Christian Bratu, Saint Nom la Breteche (FR)

( * ) Notice: Subject to any disclaimer, the term of this patent is extended or adjusted under 35 U.S.C. 154(b) by 0 days.

(21) Appl. No.: 11/577,563

(22) PCT Filed: Oct. 3, 2005

(86) PCT No.: PCT/FR2005/002424

§ 371 (c)(1),
(2), (4) Date: Apr. 19, 2007

(87) PCT Pub. No.: WO2006/051174

PCT Pub. Date: May 18, 2006

(65) Prior Publication Data

US 2007/0292287 A1 Dec. 20, 2007

(30) Foreign Application Priority Data

Nov. 9, 2004 (FR) ..... 04 11898

(51) Int. Cl.
*F01C 1/10* (2006.01)
*F03C 2/00* (2006.01)
*F04C 2/00* (2006.01)

(52) U.S. Cl. ..... 418/48; 418/220; 417/310; 417/410.4

(58) Field of Classification Search ..... 418/48, 418/152, 220; 417/423.1, 356, 310, 410.3–410.5
See application file for complete search history.

(56) References Cited

U.S. PATENT DOCUMENTS

| | | | | |
|---|---|---|---|---|
| 2,553,548 | A * | 5/1951 | Canazzi et al. | 418/48 |
| RE24,079 | E * | 10/1955 | Mateer | 418/48 |
| 3,280,963 | A * | 10/1966 | Kirker, Jr. | 198/677 |
| 4,030,862 | A * | 6/1977 | Larsson | 418/48 |
| 4,948,347 | A * | 8/1990 | Fujiwara et al. | 417/356 |

FOREIGN PATENT DOCUMENTS

| | | |
|---|---|---|
| FR | 736 434 A | 11/1932 |
| FR | 780 791 | 5/1935 |
| GB | 400 508 | 10/1933 |
| JP | 2002-364554 | 4/2003 |

OTHER PUBLICATIONS

International Search Report PCT/FR2005/002424; report dated Dec. 13, 2005.

* cited by examiner

*Primary Examiner*—Theresa Trieu
(74) *Attorney, Agent, or Firm*—Miller, Matthias & Hull

(57) ABSTRACT

The combined pump is a novel pumping system for fluids (liquids, gases) and for multiple-phase mixtures. This combined pump comprises a helical rotor on which a rotodynamic impeller is mounted. The helical rotor and impeller turns without touching inside a helical stator, and this helical rotor/impeller assembly and stator are arranged so that the cavities formed move from the suction toward the discharge. Using the rotodynamic impeller, the combined pump provides a pressurized fluid layer between the helical rotor/impeller assembly and the stator under conditions capable of improving the performances and the reliability of the pump.

11 Claims, 6 Drawing Sheets

COMBINED PUMP WITH ROTODYNAMIC IMPELLER

CROSS-REFERENCE TO RELATED APPLICATION

This is the U S. National Phase of International Application No. PCT/FR2005/002424 filed 3 Nov. 2005, claiming priority to French Patent No FR 04 11898, filed on 09 Nov. 2004.

FIELD OF THE DISCLOSURE

The present invention relates to a novel design of pump combining the positive-displacement pump concept with rotodynamic impellers having axial blades. This concept represents a combined pump in as much as it combines the two mechanical principles for the production of pumping energy: positive-displacement compression and kinetic energy.

BACKGROUND OF THE DISCLOSURE

Conventional designs comprise two clearly distinct categories of pump: positive-displacement compression systems and rotodynamic systems (centrifugal pumps).

SUMMARY OF THE DISCLOSURE

The combined pump design according to the present invention combines the positive-displacement rotor/stator system with the rotodynamic impeller having axial blades.

DETAILED DESCRIPTION OF THE DISCLOSURE

In order to explain the design of the combined pump and its advantages, we shall begin by describing the conventional progressing cavity pump (PCP) which works on a positive-displacement principle. FIG. 1 of the attached drawing gives, at (A), a schematic depiction in longitudinal part section of a conventional positive-displacement pump of the progressing cavity pump (PCP) type together with, at (B), a depiction of the pressure distribution along the pump when pumping a liquid, between the low intake pressure ($P_A$) and the high delivery pressure ($P_R$).

The design of the PCP pump 1 consists of a helical metal rotor 2 rotating inside a stator 3 of helical interior shape, generally made of elastomer. Between the rotor 2 and the stator 3 compressive contact leads to a series of isolated cavities 4 (cells, stages). Under these conditions, the cavities 4 progress from the intake side 5 towards the outlet (delivery side) 6, subjected to volumetric compression; this system transmits pressure (potential energy) to the fluid.

FIG. 1 gives, at (C), schematically, an illustration of how the pressures are transmitted between the successive cavities 4. Leaks of fluid (q, leakage flow rate) between the rotor 2 and the stator 3 transmit pressure from one cavity to the next, leading ultimately to the pressures being distributed through the cavities l, m and n. As the leaks q flow with linear pressure drops (laminar flow) the pressure distribution along the pump is uniform. FIG. 1 gives, at (D), an illustration of the distribution of pressures in the cavities l ($P_l$), m ($P_m$) and n ($P_n$). The closer the contact between the rotor 2 and the stator 3, the higher the pressure delivered by the pump. By contrast, close contact contributes to damage to the stator 3 and therefore limits the rotational speed and the output of the pump.

The reliability of the stator 3, which is made of elastomer, subjected to close contact with the metal rotor 2 rotating inside the stator 3 is the weak point of a PCP. In practice, a great increase in temperature, followed by damage to the stator 3 is observed, and this limits the service life of the PCP.

This is why industry uses PCPs 1 essentially for pumping viscous fluids at low flow rates and high pressures.

Centrifugal pumps, with rotodynamic impellers having blades, impart to the fluid velocity (kinetic energy) which is then converted in the stator into pressure (potential energy).

With no contact between the rotor and the stator, centrifugal pumps can run at high speed and thus achieve high flow rates, with a far longer life.

However, energy conversions involve losses and, in order to achieve high pressures, a great many stages are required.

In consequence, centrifugal pumps are used for low-viscosity fluids at high flow rates and modest pressures.

The combined pump according to the present invention combines the two systems, positive-displacement and rotodynamic, making it possible to achieve high pressures and high flow rates without the disadvantages of close contact between the rotor and the stator. The innovative feature of the combined pump lies in the combining of the two methods of producing pumping energy: positive-displacement and rotodynamic.

Indeed, the combined pump comprises rotodynamic impellers the purpose of which is to create a high-pressure layer of fluid between the rotor and the stator of the positive-displacement pump; this layer of fluid replaces the close contact between the rotor and the stator.

In such conditions, the combined pump is of a design with no rotor/stator contact, thus protecting the stator, improving system reliability and extending the life. In addition, without being subjected to close contact with the rotor, the stator of the combined pump can be rigid (for example made of metal) and therefore of high reliability. Also, in the absence of any close rotor/stator contact, the combined pump can rotate at high speed, like a centrifugal pump; the pumped flow rate increases without damage to the stator.

As a result, the combined pump enjoys the volumetric compression advantages of PCPs without having the disadvantages of close contact between the rotor and the stator.

The purpose of the rotodynamic impellers in the combined pump is not the same as the purpose of the impellers in centrifugal pumps (producing kinetic energy which is then converted into pressure); in the combined pump according to the invention, the rotodynamic impeller produces a pressurized layer of fluid in which the counterflow produced by the impeller blades opposes leaks leading to the dissipation of leakage energy (local pressure drops). Given the design of the impeller, delivery pressures equivalent to those achieved by a PCP can be achieved.

FIG. 2 of the attached drawing shows, at (A), a schematic depiction in axial longitudinal section of the combined pump that forms the subject of the present invention. The design of the combined pump 7 consists of a helical metal rotor 2 comprising rotodynamic impellers 8, the assembly (2 and 8) rotating inside a stator 3 of helical interior shape. There is no contact between the blades of the impeller 8 and the stator 3, the clearance being equivalent to that employed in centrifugal pumps and, in order to achieve this, the assembly comprising the rotor 2 and rotodynamic impellers 8 is kept centered by traditional bearings 12.

As can be seen in FIG. 2A, the geometry of the rotor 2 and of the stator 3 leads to a series of cavities 4, of constant volume, the purpose of the rotodynamic impeller 8 being to produce a layer of fluid at high pressure between the rotor 2 and the stator 3.

As shown by FIGS. 2A and B, the rotor 2 progresses the cavities 4 from the intake or inlet side 5 (low intake pressure PA) to the delivery or outlet side 6 (high delivery pressure PR), the pressure distribution along the pump being uniform.

FIGS. 3(A), (B) and (C) describe the way that the combined pump 7 that forms the subject of the present invention works. FIG. 3A is a view similar to FIG. 2A, on a larger scale, providing a depiction of a section of the pump of the invention to allow the pumping mechanism and the way the pressures are transmitted between two successive cavities 4 to be described. FIG. 3B depicts, on a larger scale, a diagram similar to 3A, showing the hydraulic action of the blades (a) of the rotodynamic impeller 8 and the transmission of the pressure between the cavities 4.

FIG. 3(A) illustrates, by way of nonlimiting example, the design of the combined pump of the present invention: the assembly comprising the rotor 2 and the rotodynamic impeller 8 rotating inside the stator 3 contactlessly and the cavities 4 progressing in the direction imposed by the movement of the rotor 2. Pressure is transmitted between the cavities 4 through the flow of fluid between the blades (a) of the rotodynamic impeller 8 rotating contactlessly inside the stator 3.

In order to allow a more in-depth analysis of the mechanical characteristics of the flow generated by the impeller 8, FIG. 3(B) shows the blades (a) and the complex structure of the flow leading to the pressure distribution along the pump. By way of nonlimiting example, FIGS. 3(A) and (B) depict an impeller 8 with a continuous helical blade (a) of constant pitch (h) and variable angle of inclination (b).

In general, the helical design is used for the impeller 8 or for the blade (a) to demonstrate that the flow generated as the impeller 8 and the blade (a) rotate is essentially axial with respect to the rotor.

The helical blade is a continuous axial blade developed about the rotor, because its rotation gives rise to an essentially axial flow; in what follows, the terms "helical blade", "axial blade" and "helical impeller" are used in this sense.

In consequence, it can be seen from FIGS. 3A and B that the rotation of the rotor 2 carries the helical blade (a) of the impeller 8 in a movement which generates an axial counterflow opposing the leaks q. FIG. 3(B) again considers the movement of the blades (a) of the impeller 8, on a larger scale, and describes the flow that they generate:

- the helical blade (a) displaces the pumped fluid toward the outlet 6 at an axial velocity V1. This movement creates a pressure field (+) on the downstream face (extrados) of the blade and suction (−) on the upstream face (intrados) of the blade; the pressure field is a function of the velocity of the blade V1 and the velocity of the incident flow V2, due to the flow of the leaks q between the assembly comprising the rotor 2 and the impeller 8, and the stator 3.
- thus, the helical blade (a) generates a counterflow that opposes the leaks q; under the influence of the pressure field, the confluence of the two flows becomes a vortex structure (t) that dissipates energy.

Indeed, the path of the leakage flow q, of velocity V2, is deflected inward by the suction (−), in the radial direction, where it meets, in the opposite direction, the flow generated by the blade, which is a counterflow of velocity V1, and the pressure field (+).

The resulting vortex structure (t) will dissipate energy leading to the local pressure drop ΔH over the path length between the blades (a) of the impeller 8 (FIG. 3C). If the velocity of the counterflow $V_1$ is great compared with the velocity of the leaks $V_2$, given the fact that they are in opposite directions, then the leakage flow rate q becomes negligible.

In order to demonstrate the difference between the hydraulic methods of operation of the combined pump that is the subject of the present invention, and the conventional positive-displacement pump of the PCP type, let us consider the flow between the rotor 2 and the stator 3 which determines (see FIG. 1C, D in respect of the PCP 1 and FIGS. 3A, B, C in respect of the combined pump 7):

- the pumping head H, equivalent to the pressure drops of the flow between the rotor 2 and the stator 3
- the leakage flow rate q, which is a factor in the volumetric efficiency of the pump.

In general, the performance objective for these pumps is: a high pumping head (H) and a low leakage flow rate (q), which equates to good volumetric efficiency.

In order to characterize the leakage flow (q, H) and the geometry of the system, let us adopt the following system of notation:

q . . . leakage flow rate
H . . . pumping head
I . . . hydraulic gradient
l . . . length of the pump
S . . . flow cross section
P . . . pressure;
$P_A$ . . . on the inlet side of the pump 5
$P_R$ . . . on the delivery side of the pump 6
d . . . hydraulic diameter
λ . . . linear pressure drop coefficient
ξ . . . local pressure drop coefficient
ρ . . . density of the fluid The flow rate of the leak of fluid q between the rotor 2 and stator 3 and the pumping head H can be described by the flow in a small cross-section channel (S) using the equations of conservation of mass and of energy, which lead to the following expressions:

$$q = I^{1/2} \cdot C \qquad I = \frac{H}{l}$$

$$H = (P_R - P_A)/g\rho$$

$$C = S\left(2g\frac{d}{K}\right)^{1/2} \qquad K = \lambda + \Sigma\xi\frac{d}{l}$$

$$H = \frac{q^2}{2gS^2}\left(\lambda\frac{l}{d} + \Sigma\xi\right)$$

These expressions show that the pumping head (H) and the leakage flow rate (q) are functions of the following pressure drops:

linear pressure drops, characterized by the parameter $$\left(\lambda\frac{l}{d}\right)$$

local pressure drops, the local pressure drop coefficient (ξ) of which is a function of the obstacles in the path of the leakage flow q.

The leakage q between the rotor 2 and the stator 3 of the PCP 1 (FIGS. 1C, D) takes place as a laminar film with no major obstacles with pressure drops that are essentially linear, leading to a very small flow cross section S obtained by very close contact due to the compression exerted by the rotor 2 on the stator 3.

By contrast, flow between the blades (a) of the impeller 8 of the combined pump 7 (FIGS. 3A, B, C) occurs with high local pressure drops.

The action of the rotating blades a (FIG. 3B) causes an axial counterflow opposing the leaks q, thus leading to the formation of the vortex structures (t) that dissipate energy. The pressure field on the blade is dependent on the axial velocity of the blade $V_1$ and on the velocity of the leaks $V_2$ and is given by:

$$P_+=\rho(V_1+V_2)^2$$

and $V_1$, the axial velocity of the blade with respect to the axis of the rotor (FIG. 3B), is given by:

$$V_1=R.\ \Omega.\ \tan b$$

where:

R is the radius of the blade (a)

Ω is the rotational speed of the assembly comprising the rotor 2 and the impeller 8 b is the angle of the blade a (FIG. 3A)

Consequently, if the obstacle presented by the counterflow of the blades a (FIG. 3B) is difficult to overcome, the local pressure drop (ΔH, FIG. 3C) is great and the pumping head H becomes great.

The hydraulic mechanism of operation of the conventional PCP pump 1 is based on the flow of a laminar film between the rotor 2 and the stator 3 with a very small cross sectional area (small S and d) so that the leakage flow rate (q) is small and the pressure drops great; the pressure drops of the laminar film are essentially linear (λ). As a result, a high pumping head (H) and a low leakage (q) can be obtained only if there is a very small flow cross section between the rotor 2 and the stator 3 (small S and d).

In the PCP configuration 1, the mechanism of the laminar film requires a very close fit between the rotor 2 and the stator 3 through the compression of the stator (and friction between rotor and stator), and this leads to a reduction in the reliability of the stator 3 thus restricting the rotational speed (and the pumping rate) and increasing the power consumption (of the motor).

Indeed, it is often found that the rotor 2 damages the stator 3 reducing the life of the PCP pump 1 and its running time.

As was explained already and according to FIGS. 3(A, B, C), the hydraulic mechanism of the combined pump 7 that forms the subject of the present invention is entirely different, by contrast with the conventional PCP pump 1. In order to avoid contact between the assembly comprising the rotor 2 and the impeller 8, and the stator 3, the blades a of the impeller 8 create a flow in which the pressure field and the vortices lead to dynamics that encourage a great dissipation of energy thus achieving high local pressure drops (nonlinear losses with high ξ). The slight increase in the flow cross section (S, d) between the axial blades (a) and the stator 3 is compensated for by the counterflow generated by the blades (a) of the impeller 8; the high local pressure drops (ξ) lead to a low leakage flow rate (q) and a high pumping head (H).

Under such conditions, the combined pump 7 achieves the required performance levels (high pumping head H and low leakage flow rate q) without the need for contact between the assembly comprising the rotor 2 and the impeller 8, and the stator 3. From a practical standpoint, the clearance between the blades a of the impeller 8 and the stator 3 is that employed in centrifugal pumps.

In conclusion, the pressure field and the counterflow velocities generated by the impeller a of the combined pump 7 produces a dissipative fluid layer which replaces the close contact in the conventional PCP pump 1.

In this respect the combined pump 7 that forms the subject of the present invention is a novel concept combining positive-displacement compression and a rotodynamic impeller.

Having no contact between the rotor 2 and the stator 3, the combined pump 7 has numerous advantages over the existing systems:

- the increase in the pumping flow rates and in the pumping head H,
- the stator 3 is protected and can be rigid (robust materials, metal)
- the increase in reliability and life
- the reduction in power consumption because, being contactless, there is no friction between the rotor 2 and the stator 3

In consequence, one objective of the present invention is to propose a combined pump combining positive-displacement compression with a rotodynamic impeller so as to improve performance and dispel the disadvantages of the existing systems.

Thus, the principle of operation of the combined pump 7 according to the present invention is novel and very different from the existing systems:

- the conventional PCP pump 1 with close contact between the rotor 2 and the stator 3 delivers a limited pumping flow rate, leads to a risk of damaging the stator 3 and entails high power consumption
- the combined pump 7 according to the present invention involves means for compressing the pumped fluid without any contact between the rotor 2 and the stator 3, making it possible to achieve high pumping flow rates, to improve the reliability of the stator, to increase the life of the pump and reduce the power consumption.

The means proposed for the combined pump 7 are advantageously designed to replace the close contact between the rotor 2 and the stator 3 inherent to the conventional PCP pump 1 with a pressurized layer of fluid between the rotor 2 and the stator 3.

To these ends, an objective of the present is to propose a combined pump 7 comprising a helical rotor 2 on which a rotodynamic impeller 8 is advantageously installed, the assembly comprising of the rotor 2 and the impeller 8 rotating contactlessly inside a helical stator 3, said assembly comprising the rotor 2 and the impeller 8 together with said stator 3 being positioned in such a way that the cavities 4 formed progress from the intake side 5 to the delivery side 6, characterized in that the pump 7 arranged according to the invention provides, by means of the rotodynamic impeller 8, the means advantageously designed to form a pressurized fluid layer between said assembly comprising the rotor 2 and the impeller 8 and said stator 3 under conditions capable of improving the performance and the reliability of the pump 7.

According to the invention, the combined pump 7 is characterized in that the means provided by the impeller 8 to form a fluid layer in the contactless space between the assembly comprising the rotor 2 and the impeller 8 and the stator 3 axe advantageously designed to transmit the pressures between the cavities 4 and to dissipate leakage energy so as to ensure improved pumping efficiency.

According to the invention, the rotodynamic impeller 8 installed on the rotor 2 is developed over the entire length of the rotor 2 or partially.

To this end, the rotodynamic impeller 8 is produced with blades whose size and density along the pump ensure the formation of a dissipative layer of fluid flowing as a counterflow relative to the leaks between rotor and stator. The rotation of the rotor 2 drives the impeller 8 which produces a field of pressures and velocities that oppose the leaks, and so the two flows dissipate the energy in the layer of fluid between the rotor and the stator, transmitting the pressure between the successive cavities. In consequence, the layer of fluid produced by the rotodynamic impeller 8 replaces the close contact between the rotor 2 and the stator 3.

The performance of the combined pump 7 is controlled through the design of the rotodynamic impeller 8 and the optimum sizing of its blades is the chief factor: the length of the chord, the pitch (h), the angles of incidence (b) and the slope, thickness and density of the blades, and also the clearance between the blades and the stator.

According to a first particular embodiment of the means, the rotodynamic impeller a comprises a helical blade, installed on the helical rotor 2 of the pump. The pitch of the blade (h) may be constant and then the angle (b) can vary, or the pitch of the blade can vary and the angle becomes constant. In general, the blade may have variable pitch and variable angle, but in practice certain parameters are kept constant in order to facilitate manufacture.

According to a second particular embodiment of the means, the rotodynamic impeller 8 comprises several helical blades installed with an offset, on the helical rotor. In general, the pitch and the angle of the blades may vary but in practice, some of the parameters are kept constant.

According to a third particular embodiment of the means, the rotodynamic impeller comprises a set of discontinuous blades installed on the rotor.

The three particular embodiments may be implemented simultaneously in the same pump.

In general, the design of the blades (the entry and exit angles, the angle of incidence, the chord length, the curvature, the thickness) produces and ensures the effectiveness of the layer of fluid between the rotor and the stator.

Industrial applications of the combined pump 7 according to the present invention cover a broader spectrum than is covered by existing PCP pumps 1, under markedly improved conditions of reliability, operating time and power consumption. As examples, mention may be made of the pumping of viscous fluids and multiple-phase mixtures (liquids, gases, solid particles) used in the petrochemical industry, the chemical industry and the food industry.

BRIEF DESCRIPTION OF THE DRAWINGS

In order better to illustrate the subject of the present invention, a number of particular embodiments given solely by way of nonlimiting examples will be described hereinafter with reference to the attached drawing, in which:

Hence, FIGS. 2 and 4 to 8 show particular embodiments of the combined pump according to the invention.

FIG. 2A is an overall view, in axial longitudinal section, of the combined pump 7 according to the present invention, with the rotodynamic impeller 8 depicted installed on the helical rotor 2, the assembly comprising the rotor 2 and the impeller 8 rotating inside the helical stator 3; as there is no contact between the assembly comprising the rotor 2 and the impeller 8, and the stator 3, the rotor 2 is supported by traditional bearings 12. Rotation of the rotor 2 progresses the cavities 4 of pumped fluid from the intake side 5 toward the delivery side 6; the pressure distribution is uniform (FIG. 2B) from the low intake pressure ($P_A$) to the high delivery pressure ($P_R$).

In FIGS. 4A and B the system consists of a helical rotor 2 on which there is installed a rotodynamic impeller 8 with a helical blade which generates an axial counterflow, the assembly comprising the rotor 2 and the impeller 8 rotating inside the stator 3 without contact. FIG. 4(A) shows the rotodynamic impeller 8 with a helical blade of constant pitch (h=ct) and a variable angle (b). FIG. 4(B) depicts the impeller 8 with a helical blade of constant angle (b=ct) and variable pitch (h).

FIG. 5 shows a thick-bladed variant 9 of the rotodynamic impeller B described in FIG. 4(A), with a helical blade of constant pitch (h).

FIG. 6 depicts the rotodynamic impeller 8 with double helical blades 10 installed on the helical rotor 2 with a 180° offset; the blades 10 have a constant pitch (h) and a variable angle (b).

FIG. 7 depicts the rotodynamic impeller 8 with discontinuous axial blades 11 installed on the rotor 8, the assembly rotating inside the stator 3.

FIG. 8 depicts the rotodynamic impeller 8 with continuous helical blades 13 over each cavity 4; between the cavities, over a limited length, the rotor 2 has a diameter equal to the diameter of the blades 13 of the impeller 8.

EXAMPLE

The following example illustrates the design of the combined pump according to the invention without, however, restricting its scope.

For this illustration we shall describe an example of a combined pump the hydraulic performance aspects of which are equivalent to those of a PCP.

The reference PCP has the following characteristics: the pump length is l=3.5 m, the rotor diameter D=30 mm, the outside diameter of the pump OD=90 mm. The pump performance at the rotational speed of N=500 rpm (revolutions per minute) is: the pumped flow rate is Q=100 $m^3$/day, the pumping head (in meters of water) H=600 m, and the volumetric efficiency is 0.9, which means that the leakage flow rate between the rotor and the stator is q=10 $m^3$/day. The rotor compresses the stator and the flow cross section between the rotor and the stator is small: the surface area is S=0.47 $cm^2$ and the equivalent hydraulic diameter d=0.25 mm.

Under these conditions, the corresponding Reynolds number, is Re=1000, which demonstrates that the flow is a laminar flow.

The pumping head H is:

$$H = \left(\lambda \frac{1}{d}\right)\frac{V^2}{2g} = 600 \text{ m}$$

Figure 1:
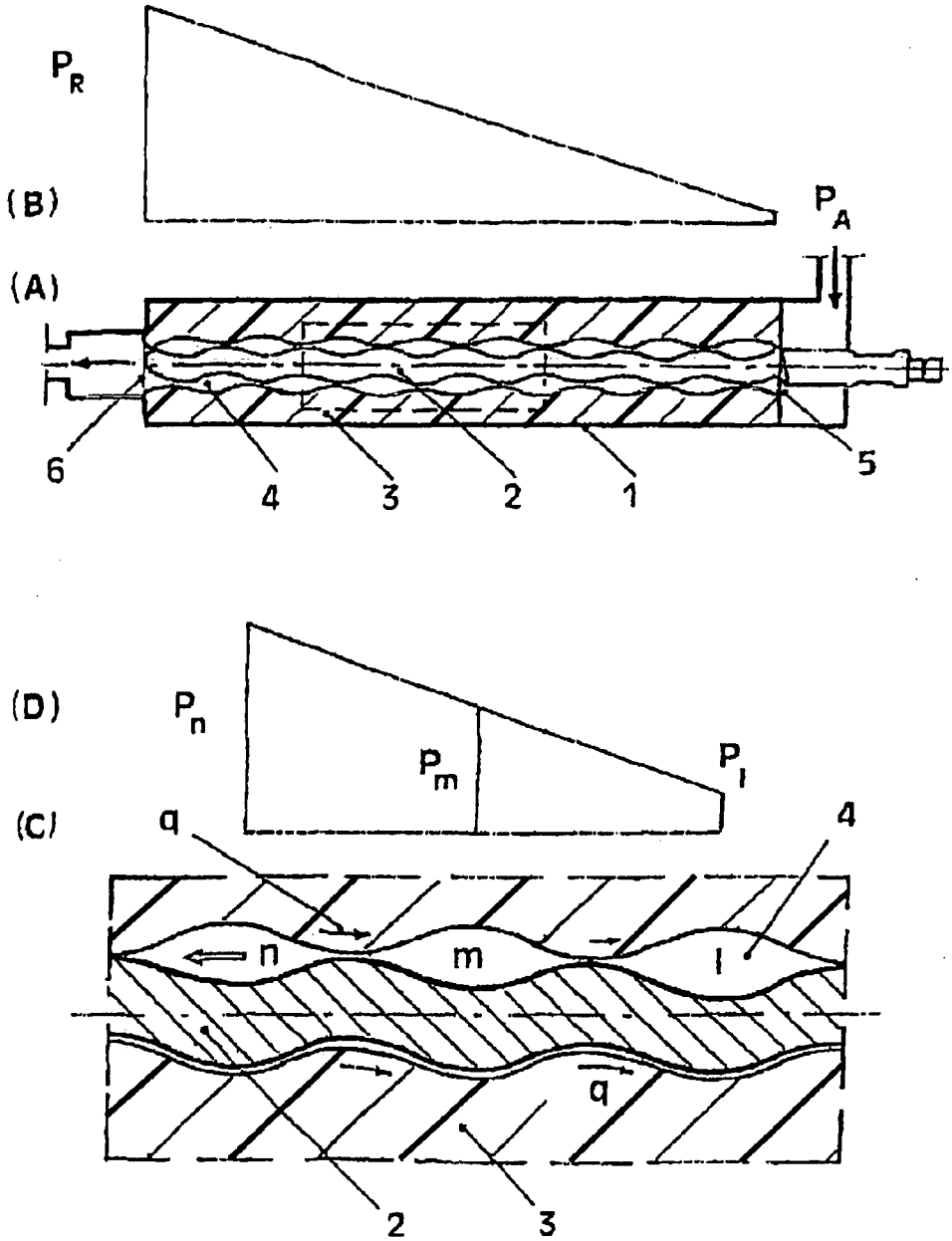
FIG.1 (PRIOR ART)
FIG. 1 depicts the conventional PCP pump (A) with a depiction of the leakage flow between the rotor and the stator (C) and the distribution of the pressures generated (B and D)
Figure 2:
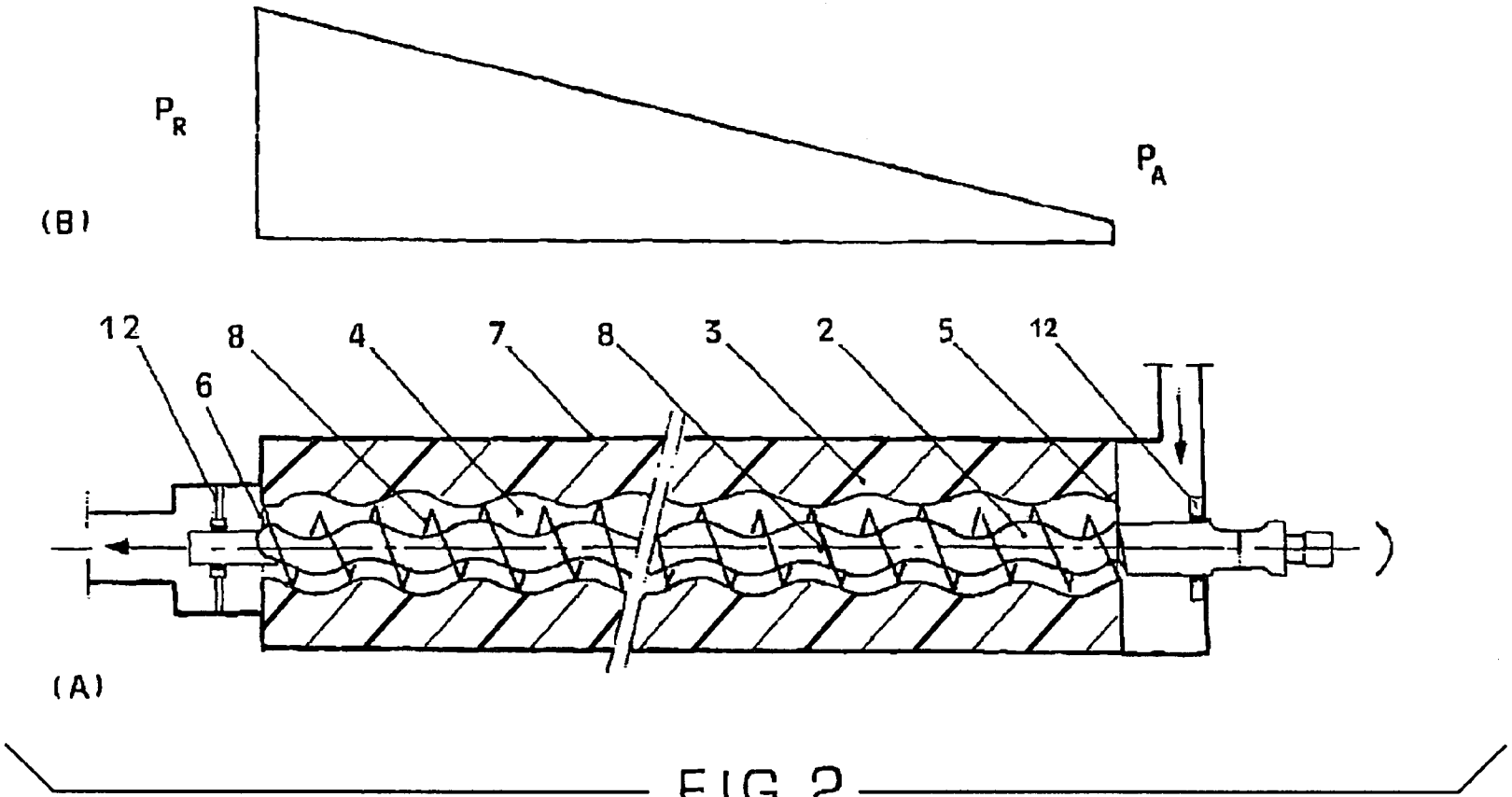
FIG. 2 gives, at (A), a depiction of the combined pump according to the present invention and the pressure distribution (B)
Figure 3:
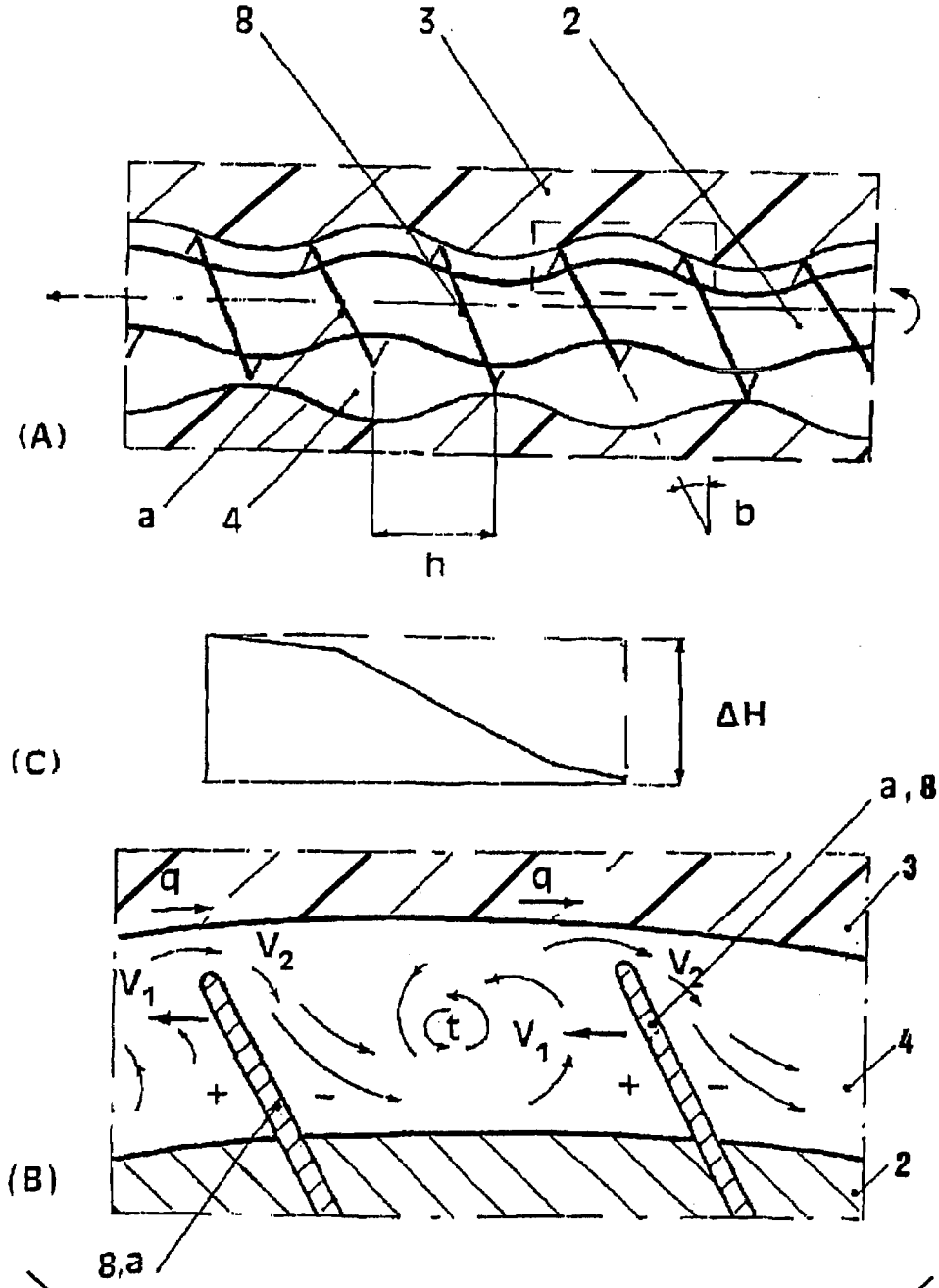
FIG. 3 gives, at (A), a view similar to FIG. 2 (A), on a larger scale, and describes the hydraulic method of operation (B) and the local pressure drops (C)
Figure 4:
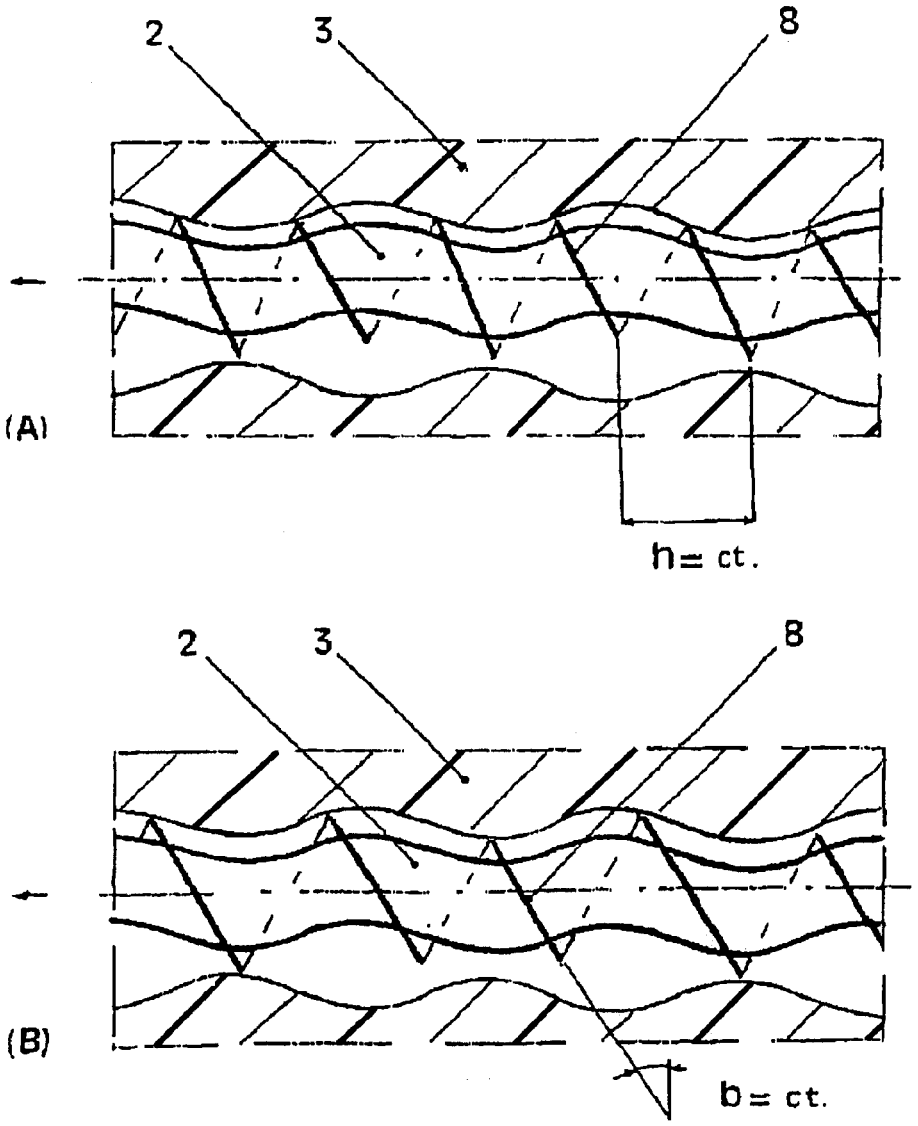
FIG. 4 gives a depiction the rotodynamic impeller with helical blades, with a constant pitch h and a variable angle b (FIG. 4A), and with a constant angle b and a variable pitch h (FIG. 4B)
Figure 5:
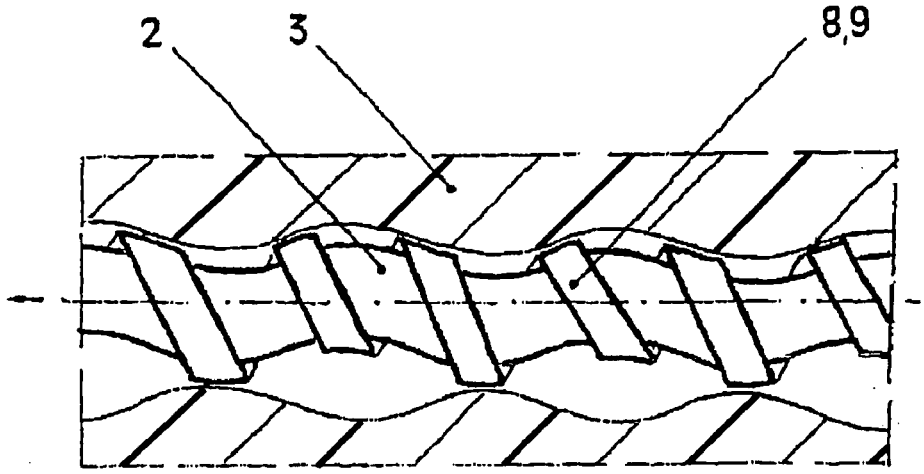
FIG. 5 gives a depiction of the rotodynamic impeller with thick helical blade.
Figure 6:
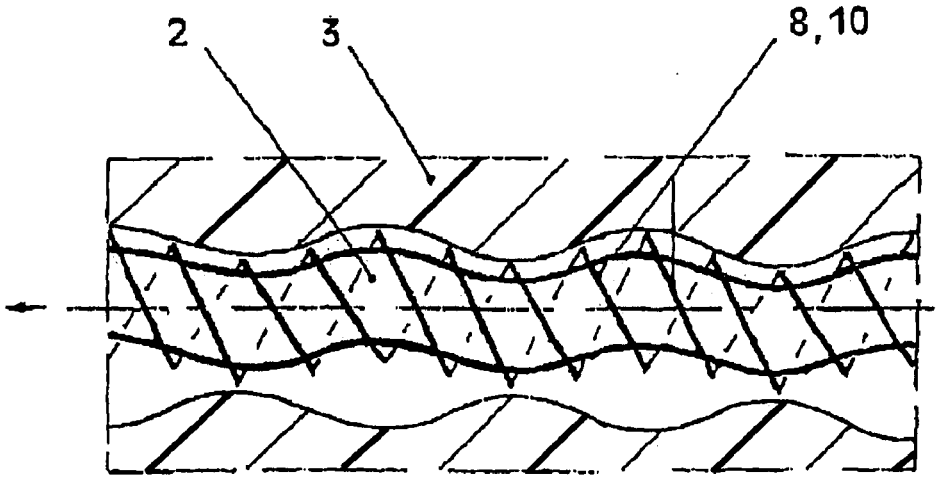
FIG. 6 gives a depiction of the rotodynamic impeller the two helical blades of which are offset by 180°, have a constant pitch h and a variable angle b.
Figure 7:
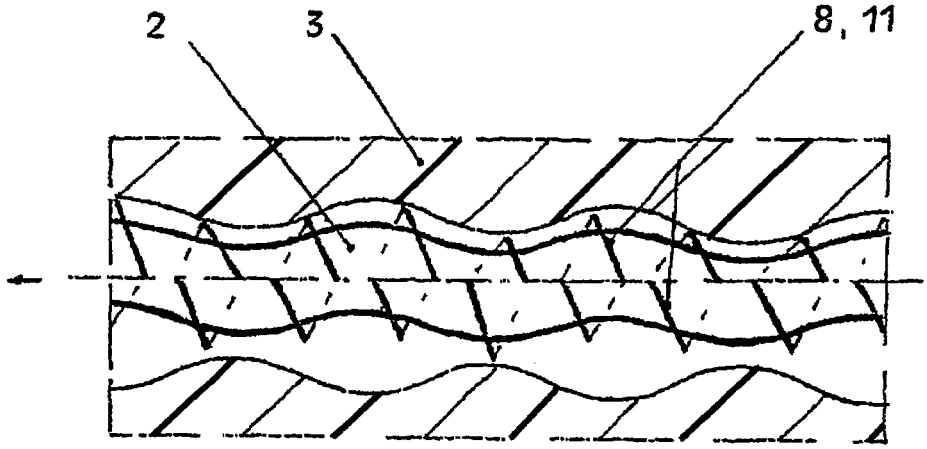
FIG. 7 schematically shows the rotodynamic impeller with discontinuous axial blades.
Figure 8:
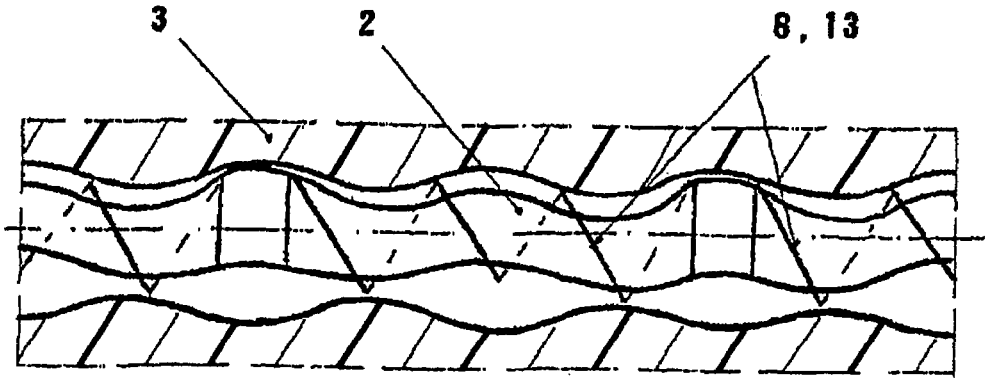
FIG. 8 gives a depiction of a rotodynamic impeller with a continuous helical blade over each cavity, with a transition between the cavities, in which transition the diameter of the rotor is equal to the diameter of the blades of the impeller.

Let us consider the combined pump the rotor of which has the same diameter (D=30 mm) and on which a helico-axial impeller with a continuous helical blade is installed (FIG. 4A). The constant pitch of the blade is h=5 cm, which means that over the length of the pump (l=3.5 m) there are 70 complete turns of the helix.

The outside diameter of the impeller is De=40 mm and so the height of the blade is 5 mm; the space between the blade and the stator is approximately 1 mm, equivalent to that used in centrifugal pumps. The velocity of the leakage flow q is $v_2$=1 m/s, while the velocity of the counterflow generated by the blade is $V_1$=0.5 m/s. Under these conditions, the local pressure drop coefficient can be taken by analogy with hydraulic obturators used in industry (orifice plates, mushroom valves, valves), which amounts to ξ=75 and so the pumping head is:

$$H = \Sigma\xi\frac{V^2}{2g} = 600 \text{ m.}$$

The rotodynamic impeller of this pump consists of a continuous helix over the entire length of the pump, the helico-axial blade of which has a constant pitch h=5 cm, which amounts to 70 complete turns of the helix along the length of the pump. Given the fact that the height of the blade is 5 mm and the clearance between the blade and the stator is 1 mm, the stator of the combined pump needs to have an equivalent reduction (12 mm).

In consequence, the combined pump according to the invention has hydraulic performance (the flow rate and the pumping head) equivalent to the PCP pump.

However, the combined pump has a clearance between the assembly comprising the rotor and the impeller, and the stator, thus protecting the stator and leading to energy savings Likewise, the rotational speed and the flow rate can be increased without damaging the stator. Specifically, the pumping flow rate is proportional to the rotational speed and by rotating at N=1000-2000 rpm, the flow rate is increased by a factor of 2-4.

The invention claimed is:

1. A combined pump comprising:

a stator having an inner housing with a helical sidewall, the helical sidewall axially extending inside said stator; and a rotary assembly housed inside said stator housing;

wherein said rotary assembly comprises:

a helical rotor inside said stator housing and having an outer sidewall distant from said helical sidewall of said stator housing; and a rotodynamic impeller fixedly supported around said rotor, said rotodynamic impeller radially projecting from said rotor without contacting said helical sidewall of said stator housing; whereby said rotary assembly and said helical sidewall of said stator together define cavities progressing from an intake end of the pump to a delivery end of the pump, and whereby a pressurized fluid layer is formed in a space between said rotary assembly and said helical sidewall of said stator housing and is adapted to transmit pressures between said cavities and to dissipate leakage energy so as to ensure improved pumping efficiency.

2. The combined pump as claimed in claim 1, wherein said rotodynamic impeller extends over the entire length of the rotor.

3. The combined pump as claimed in claim 1, wherein said rotodynamic impeller comprises at least one helical blade.

4. The combined pump as claimed in claim 3, wherein said at least one helical blade of said rotodynamic impeller has a constant pitch and a variable inclination angle relative to a plane perpendicular to an axis of said rotor.

5. The combined pump as claimed in claim 3, wherein said at least one helical blade of said rotodynamic impeller has a variable pitch and a constant inclination angle relative to a plane perpendicular to an axis of said rotor.

6. The combined pump as claimed in claim 3, wherein said at least one helical blade of said rotodynamic impeller has a variable pitch and a variable inclination angle relative to a plane perpendicular to an axis of said rotor which can be varied.

7. The combined pump as claimed in claim 1, wherein said rotodynamic impeller comprises a set of discontinuous blades, whereby hydrodynamic characteristics of said such arranged rotodynamic impeller ensure that a pressurized fluid layer is formed between said rotor and rotodynamic impeller and said helical sidewall of said stator housing.

8. The combined pump as claimed in claim 1, wherein said rotodynamic impeller comprises a set of continuous blades positioned along the length of each of said cavities, and wherein, between said cavities, said rotor has a diameter equal to that of said blades of said rotodynamic impeller.

9. The combined pump as claimed in claim 1, wherein said rotodynamic impeller comprises thick blades such that channels are defined between said thick blades and said helical sidewall of said stator housing.

10. An application of the combined pump as defined in claim 1 to the pumping of fluids, said fluids comprising one or more selections from a group consisting of liquids, viscous liquids and gases, and to the pumping of multiple-phase mixtures, said mixtures comprising one or more selections from a group consisting of liquids, and gases and solid particles.

11. The combined pump as claimed in claim 1, wherein said rotodynamic impeller extends over a partial length of the rotor.

* * * * *